US011247493B2

(12) United States Patent
Scherdel

(10) Patent No.: US 11,247,493 B2
(45) Date of Patent: Feb. 15, 2022

(54) DEVICE AND METHOD FOR DRYING A RECORDING MEDIUM WITH REDUCED CONNECTED LOAD

(71) Applicant: Canon Production Printing Holding B.V., Venlo (NL)

(72) Inventor: Stefan Scherdel, Markt Schwaben (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/913,470

(22) Filed: Jun. 26, 2020

(65) Prior Publication Data

US 2020/0406637 A1 Dec. 31, 2020

(30) Foreign Application Priority Data

Jun. 28, 2019 (DE) ..... 102019117551.8

(51) Int. Cl.
*B41J 11/00* (2006.01)

(52) U.S. Cl.
CPC ..... *B41J 11/002* (2013.01)

(58) Field of Classification Search
CPC .. B41J 11/002; B41J 11/0022; B41F 23/0466; B41F 23/0426
See application file for complete search history.

(56) References Cited

U.S. PATENT DOCUMENTS 4,336,279 A 6/1982 Metzger
6,766,593 B2 * 7/2004 Laudat ..... B41J 11/0022 34/275

FOREIGN PATENT DOCUMENTS

DE 10115066 A1 10/2002

OTHER PUBLICATIONS

German Office Action dated Apr. 22, 2020, for Application No. 10 2019 117 551.8.

* cited by examiner

*Primary Examiner* — Bradley W Thies
(74) *Attorney, Agent, or Firm* — Schiff Hardin LLP

(57) ABSTRACT

A drying device includes a storage unit in which energy (e.g. thermal energy) may be stored during a charging phase. The stored energy may be used at the beginning of a subsequent printing phase to warm a drying medium (e.g. air) to dry a recording medium that has been printed to. The maximum required connected electrical load of the drying device is advantageously and efficiently reduced.

14 Claims, 4 Drawing Sheets

DEVICE AND METHOD FOR DRYING A RECORDING MEDIUM WITH REDUCED CONNECTED LOAD

CROSS REFERENCE TO RELATED APPLICATIONS

This patent application claims priority to German Patent Application No. 102019117551.8, filed Jun. 28, 2019, which is incorporated herein by reference in its entirety.

BACKGROUND

Field

The disclosure relates to a device and a corresponding method for drying a recording medium. In particular, the disclosure relates to the reduction of the connected load for a drying device.

Related Art

Inkjet printing devices may be used for printing to recording media (such as paper, for example). For this, one or more nozzles are used in order to fire ink droplets toward the recording medium, and thus in order to generate a desired print image on the recording medium.

An inkjet printing device may comprise one or more drying devices in order to dry the recording medium after application of the print image, and in order to thereby fix the applied ink on the recording medium. A drying device may have a drying route with a plurality of drying modules. The individual drying modules may be configured in order to blow a warmed, gaseous drying medium, in particular air, onto the surface of the recording medium in order to dry said recording medium. The drying modules may thereby be arranged along the drying route such that the recording medium does not come into contact with the drying modules and floats through the drying device.

To dry a recording medium that has been printed to, a defined drying energy is required that is to be generated even at the beginning of the printing operation or at the beginning of a printing phase of a printing device. However, at the beginning of a printing phase, the drying device has typically not been completely warmed up. In order to nevertheless rapidly apply the required drying energy, the electrical load of the drying device may be increased, which is, however, linked with additional costs for the connection of the drying device to an electrical supply network. Alternatively or additionally, at the beginning of the printing operation, the transport velocity of the recording medium may be reduced in order to increase the available time period for drying of the recording medium. However, the print quality may be negatively affected due to the printing during a ramping of the transport velocity.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
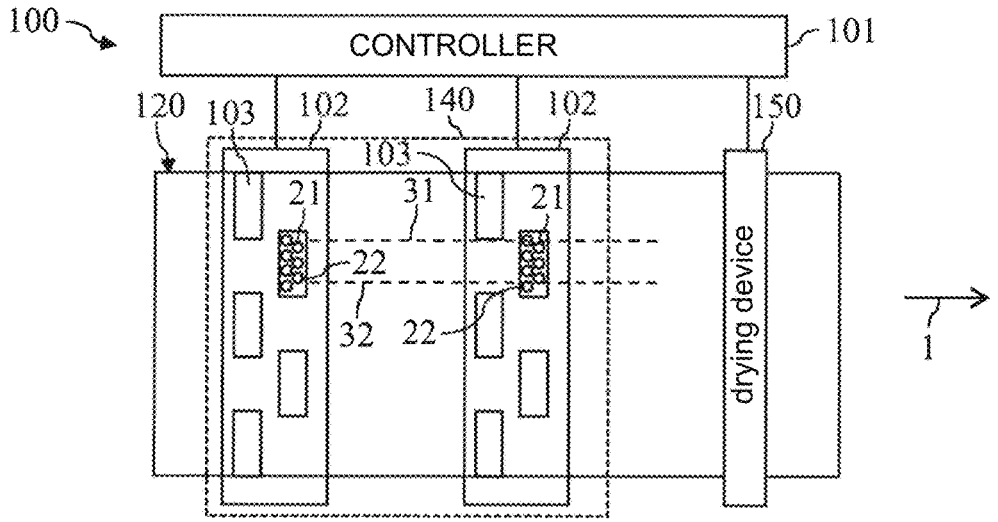

FIG. 1*a* illustrates a block diagram of an inkjet printing device having a drying or fixing device according to an exemplary embodiment.

Figure 1B:
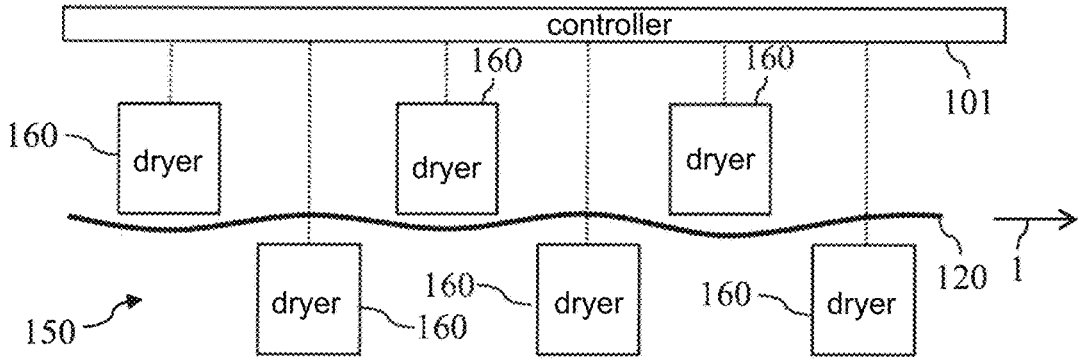

FIG. 1*b* illustrates a block diagram of a drying device for an inkjet printing device according to an exemplary embodiment.

Figure 1C:
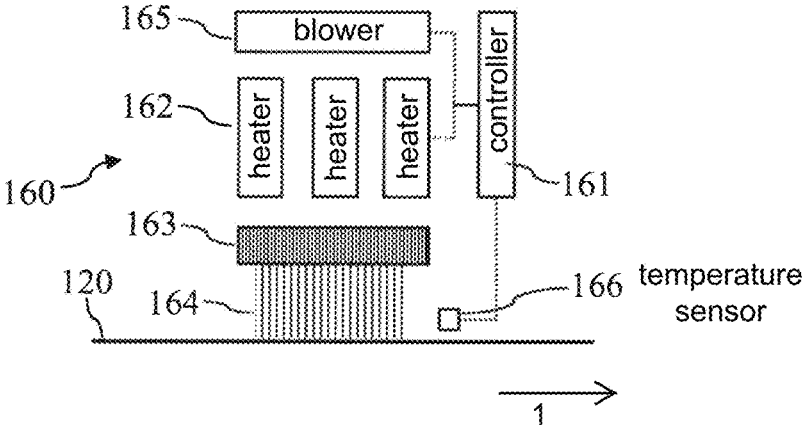

FIG. 1*c* illustrates a block diagram of a dryer for a drying device according to an exemplary embodiment.

Figure 2A:
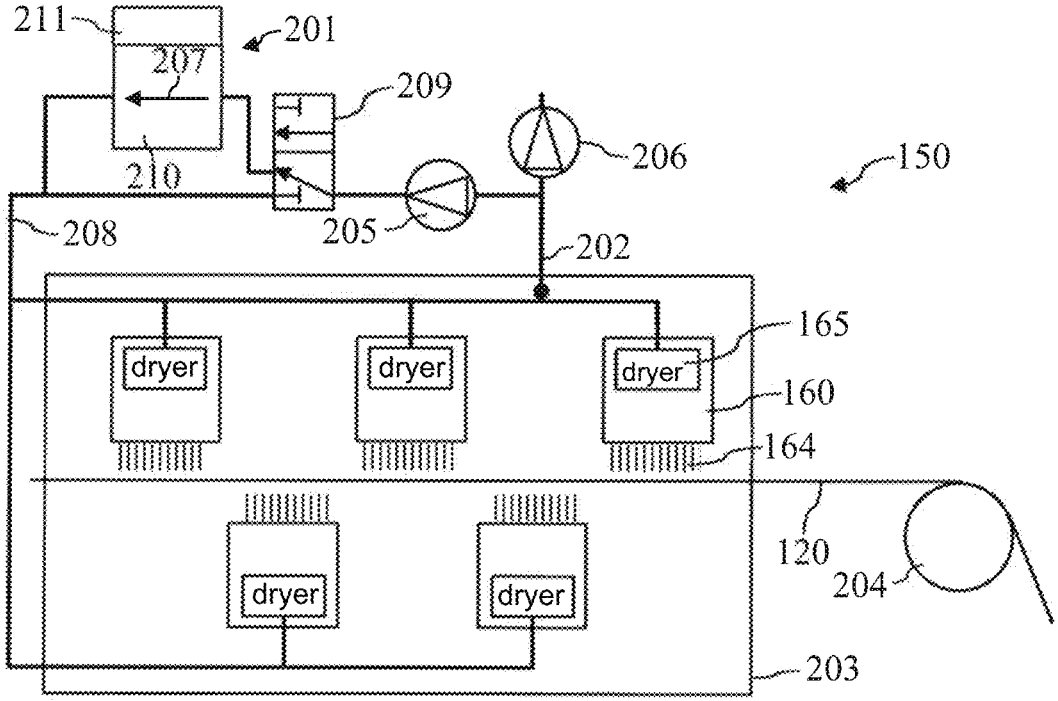

FIG. 2*a* illustrates a drying device having a thermal energy storage according to an exemplary embodiment.

Figure 2B:
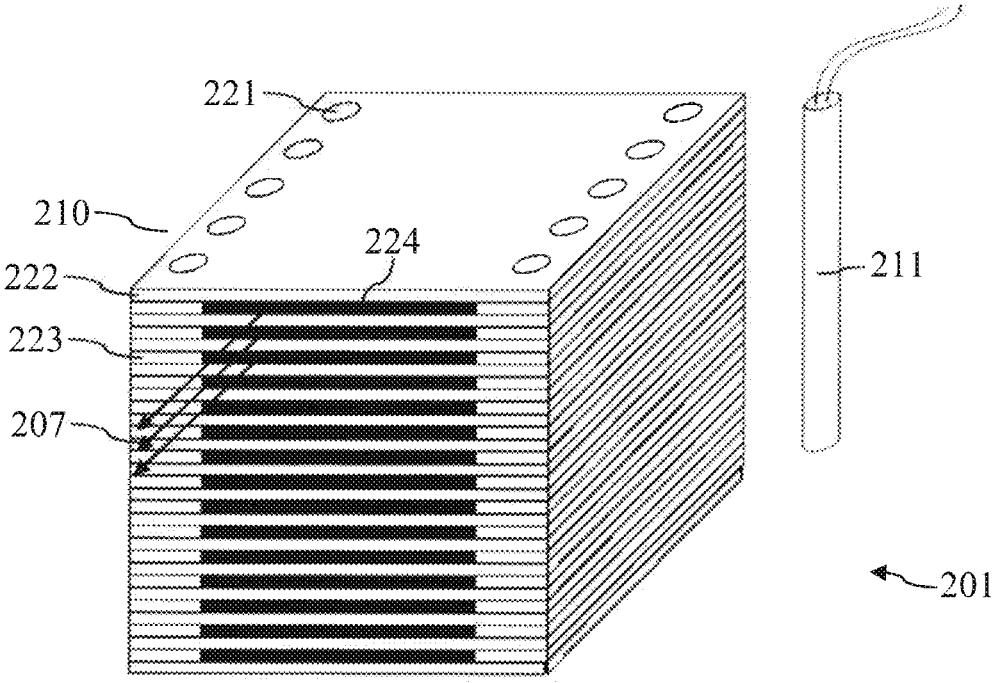

FIG. 2*b* illustrates a thermal energy storage according to an exemplary embodiment.

Figure 3A:
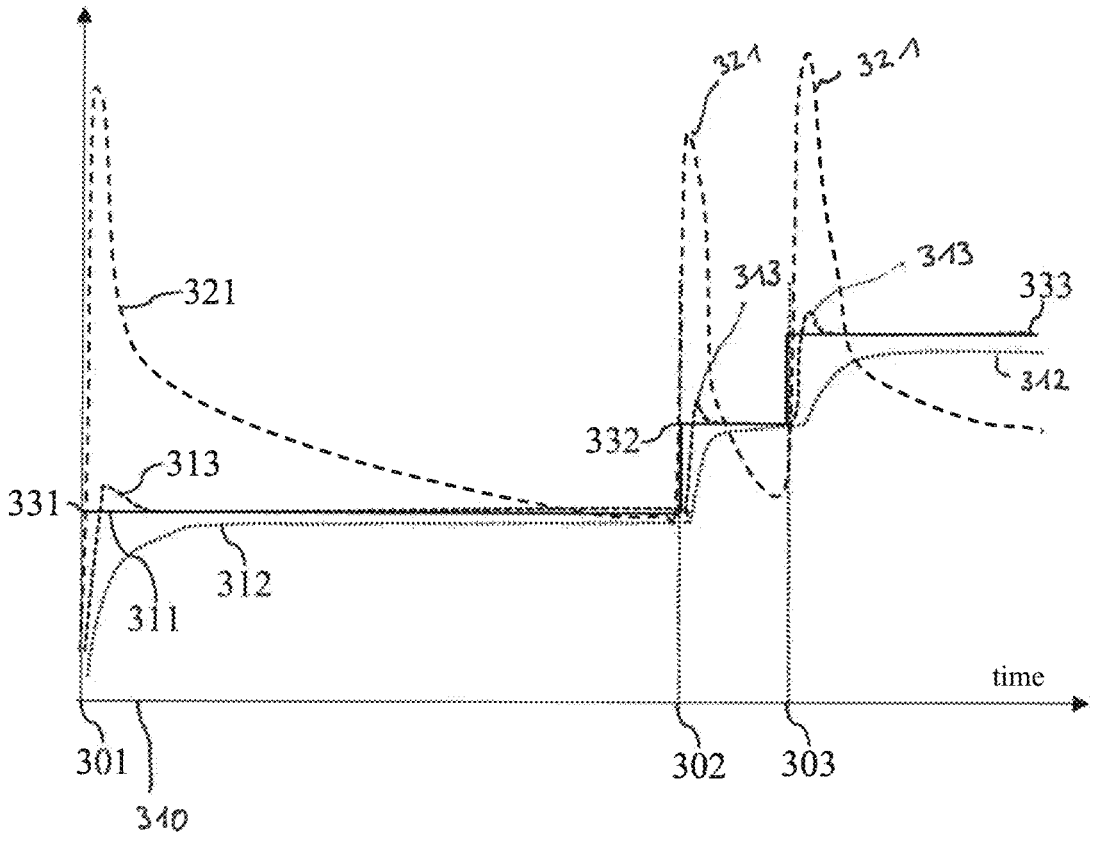

FIG. 3*a* illustrates example temperatures of a dryer before and at the beginning of a printing phase, in the event that a sufficiently high connected electrical load is available, according to an exemplary embodiment.

Figure 3B:
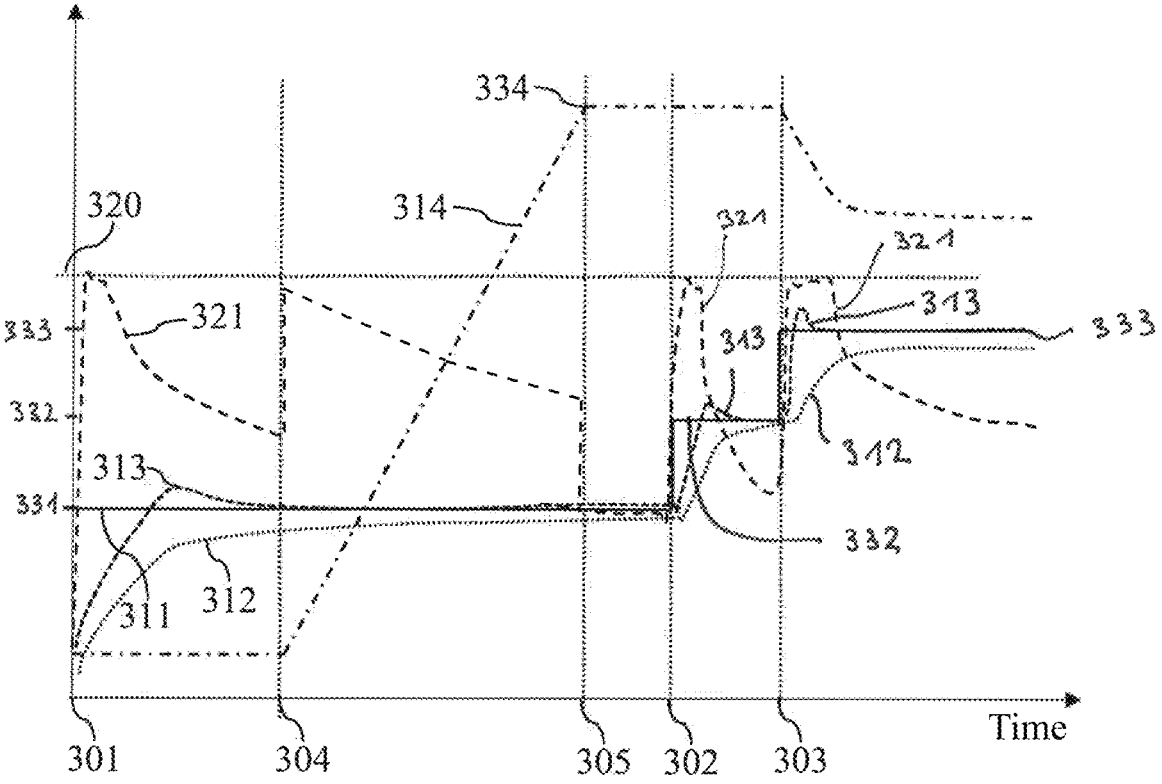

FIG. 3*b* illustrates example temperatures of a dryer before and at the beginning of a printing phase, given the use of an energy storage, according to an exemplary embodiment.

Figure 4:
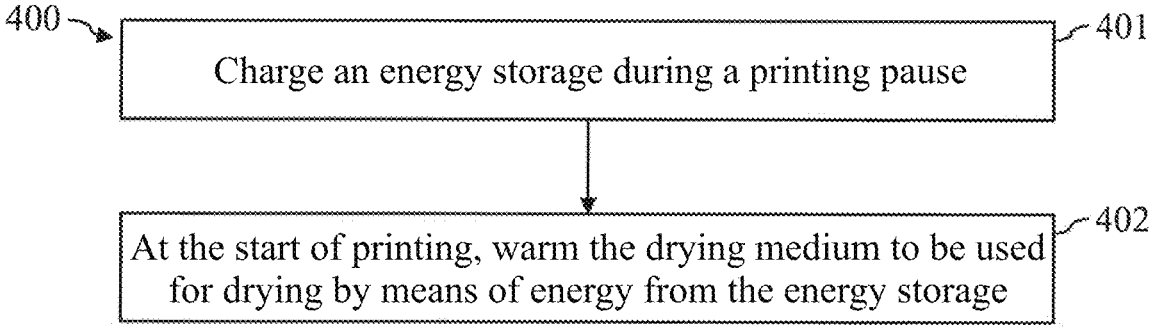

FIG. 4 illustrates a flowchart of a method for drying a recording medium according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object the present disclosure is to provide a drying device that, immediately at the beginning of a printing phase, efficiently has the drying energy required to dry a recording medium, in particular so that the printing phase may be begun without a ramping of the transport velocity of the recording medium.

According to one aspect of the disclosure, a drying device is described for drying a recording medium printed to in a printing device. In an exemplary embodiment, the drying device comprises at least one dryer that is configured to warm a gaseous drying medium by means of at least one heating element and to blow said gaseous drying medium onto a surface of the recording medium. Furthermore, the drying device comprises a storage unit to store energy. In an exemplary embodiment, the drying device also comprises a controller that is configured to induce energy to be stored in the storage unit in a charging phase, and that is configured to induce the printing device to be warmed with energy from the storage unit and via operation of the heating element of the dryer at the beginning of a printing phase of the printing device.

According to a further aspect of the disclosure, a method is described for drying a recording medium by means of a drying device, said recording medium being printed to in a printing device. In an exemplary embodiment, the method includes the storing of energy in the storage unit of the drying device during a charging phase. Furthermore, the method includes the warming of a drying medium, at the beginning of a printing phase of the printing device, via operation of the one or more heating elements of at least one dryer of the drying device, and using the stored energy from the storage unit.

FIG. 1*a* illustrates a printing device (printer) 100 according to an exemplary embodiment. In an exemplary embodiment, the printer 100 is designed for printing to a recording medium 120 in the form of a sheet or page or plate or belt, but is not limited thereto. The recording medium 120 may be produced from paper, paperboard, cardboard, metal, plastic, textiles, a combination thereof, and/or other materials that are suitable and can be printed to. The recording medium 120 is directed along the transport direction 1 (represented by an arrow) through the print group 140 of the printing device 100.

In the depicted example, the print group 140 of the printing device 100 comprises two print bars 102, wherein each print bar 102 may be used for printing with ink of a defined color, for example for ink of the colors black, cyan, magenta, and/or yellow, and/or if applicable for MICR ink. Different print bars 102 may be used for printing with respective different inks. Furthermore, the printing device 100 typically comprises at least one fixing or drying device that is configured to fix a print image printed on the recording medium 120.

A print bar 102 may comprise one or more print heads 103 that are arranged side by side in a plurality of rows in order to print the dots of different columns 31, 32 of a print image onto the recording medium 120. In the example depicted in FIG. 1*a*, a print bar 102 comprises five print heads 103, wherein each print head 103 prints the dots of one group of columns 31, 32 of a print image onto the recording medium 120.

In an exemplary embodiment, as shown in FIG. 1*a*, each print head 103 of the print group 140 comprises a plurality of nozzles 21, 22, wherein each nozzle 21, 22 is configured to fire or eject ink droplets onto the recording medium 120. A print head 102 of the print group 140 may, for example, comprise multiple thousands of effectively utilized nozzles 21, 22 that are arranged along multiple rows transversal to the transport direction 1 of the recording medium 120. By means of the nozzles 21, 22 of a print head 103 of the print group 140, dots of a line of a print image may be printed on the recording medium 120 transversal to the transport direction 1, meaning along the width of the recording medium 120.

In an exemplary embodiment, the printing device 100 also comprises a controller 101 (e.g. activation hardware and/or a processor) that is configured to control the actuators of the individual nozzles 21, 22 of the individual print heads 103 of the print head 140 in order to apply the print image onto the recording medium 120 depending on print data. In an exemplary embodiment, the controller includes processor circuitry that is configured to perform one or more functions and/or operations of the controller 101, such as controlling the actuators, controlling the drying device(s), and/or controlling one or more operations (including the overall operation) of the printing device 100.

The print group 140 of the printing device 100 thus comprises at least one print bar 102 having K nozzles 21, 22 that may be activated with a defined line clock cycle in order to print a line that travels transversal to the transport direction 1 of the recording medium 120, with K pixels or K columns 31, 32 of a print image, onto the recording medium 120, for example with K>1000. In the depicted example, the nozzles 21, 22 are installed immobile or fixed in the printing device 100, and the recording medium 120 is directed past the stationary nozzles 21, 22 with a defined transport velocity.

As presented above, in an exemplary embodiment, the printing device 100 includes a drying device 150 that is configured to dry the recording medium 120 after application of the ink by the one or more print bars 102, and therefore to fix the applied print image onto the recording medium 120. For this, the drying device 150 may be controlled by a controller 101 of the printing device 100. For example, the drying may take place depending on the quantity of applied ink and/or depending on a type of the recording medium 120. For example, the temperature and/or the volumetric flow of the gaseous drying medium may be adapted depending on the quantity of applied ink and/or depending on a type of the recording medium 120.

According to an exemplary embodiment and with reference to FIG. 1*b*, the drying device 150 includes a plurality of dryers 160 that are arranged along a drying route on both sides of the recording medium 120, typically a recording medium 120 in the form of a web, and that are respectively configured to blow a gaseous drying medium, typically warmed air, onto the surface of the recording medium 120. The print image on a recording medium 120 may thus be gently and reliably dried along the drying route of the drying device 150.

FIG. 1*c* shows a block diagram with examples of components of a dryer 160 according to an exemplary embodiment. In an exemplary embodiment, the dryer 160 is a convection dryer and includes a blower 165 with which a gaseous drying medium e.g. air) may be directed past one or more heating elements 162. The gaseous drying medium may be heated or cooled. The drying medium 164 warmed by the heating elements 162 is then blown via one or more openings or nozzles 163 onto the surface of the recording medium 120. The one or more nozzles 163 may respectively be round hole nozzles, whereby a particularly good thermal transfer from the warmed drying medium 164 to the recording medium 120 may be produced. The delivery rate of the blower 165, and/or the heating power of the one or more heating elements 162, may be controlled or regulated via a controller 161 of the dryer 160, wherein the controller 161 may, if applicable, be part of the controller 101 of the drying device 150 or of the printing device 100. In particular, the temperature in the surroundings of the recording medium 120 may be detected by means of a temperature sensor 166. The controller 161 may be configured to control or regulate the blower 165 and/or the one or more heating elements 162 depending on sensor data of the temperature sensor 166. In an exemplary embodiment, the temperature sensor 166 is specifically configured to measure the temperature of the recording medium 120. For example, a defined temperature in the surroundings of the recording medium 120 may thus be set.

In an exemplary embodiment, a no-contact float drying by means of forced convection may thus be used to dry a recording medium 120. As shown in FIG. 1*b*, for this purpose the individual dryers 160 may be arranged alternately on the front side and the back side of the recording medium 120 along the drying route. The recording medium 120 may then be pushed and/or drawn through the drying device 150, floating past the dryers 160.

FIG. 3*a* shows examples of measured values upon starting up a drying device 150, according to an exemplary embodiment. At a first point in time 310, the one or more dryers 160 are pre-heated to a nominal temperature 311 with a first nominal temperature value 331 of, for example, 120° C. The first nominal temperature value 331 is thereby preferably optimally close to the target nominal temperature value 333 used for drying, for example of 200° C. On the other hand, the first nominal temperature value 331 is preferably sufficiently low in order to avoid that the stationary recording medium 120 is negatively affected by a relatively long action of the tempered drying medium 164, for example of 20 minutes or more.

FIG. 3*a* shows the time curve of the temperature 312 of the housing of a dryer 160 and the time curve of the temperature 313 of the drying medium 154 provided by the drying medium 160 according to an exemplary embodiment. Furthermore, FIG. 3*a* shows the electrical load 321 that is required to operate the heating elements 162 of the one or more dryers 160. It is apparent that a relatively high electrical load 321 is required, in particular at the beginning of the pre-warming phase, whereas the electrical load 321 is relatively low in the further course of the pre-warming phase.

At a second point in time 302, the nominal temperature 311 may be increased to a second nominal temperature value 332 of, for example, 155° C. in order to advance the nominal temperature 311 in steps to the target nominal temperature value 333 for the printing operation or for a printing phase. This temperature increase in turn causes a temporary spike in the electrical load 321. At a third point in time 303, the nominal temperature 311 may then be set to the target nominal temperature value 333 of, for example, 200° C., whereby a spike of the electrical load 321 is caused in turn. The third point in time 303 may correspond to the point in time of the beginning of a printing phase. For example, the recording medium 120 may be set into motion at the third point in time 303 for printing in the printing device 100.

For the operation of a drying device 150, at least upon startup of said drying device 150, a relatively high electrical load 321 may be required temporarily to heat the one or more dryers 160. This may lead to increased costs for the provisioning of a correspondingly designed mains connection.

Alternatively, the electrical load 321 may be limited to a defined maximum value. However, the limitation of the electrical load 321 may result, especially given relatively heavy papers 120, that upon the start of printing the necessary temperature of the drying medium 164 is only reached after a certain time of, for example, one to two minutes. Therefore, it may be required that the printing is started with a reduced velocity in order to be able to apply the required drying energy to the recording medium 120 even given a reduced heating power. With increasing temperature of the drying medium 164, the velocity may be increased bit by bit to the nominal velocity for the printing phase. The printing may thus be started with a velocity ramping.

However, the printing during the ramping may have one or more disadvantages. The fixing quality during the ramping time may possibly be reduced since the temperature of the recording medium 120 cannot be set with sufficient precision. Given duplex printing, difficulties in the alignment of front and back side may also occur due to a non-uniform shrinking of the recording medium 120. The non-uniform shrinking may thereby be produced by the changing of the fixing duration and the fixing temperature in the ramping. The productivity of the printing device 100 is also reduced by printing during the ramping. Moreover, fluctuations in the print quality may occur due to the changing of the print speed and the adaptation linked therewith of the activation signals for the nozzles 21, 22.

As depicted in FIG. 2*a*, in an exemplary embodiment, the drying device 150 includes a storage unit 201 that is configured to store energy that may be used to limit the one or more spikes of the electrical load 321, and to nevertheless enable a short-term heating of the drying medium 164 to the target nominal temperature value 333 so that printing with a velocity ramping may be foregone.

In an exemplary embodiment, the storage unit 201 is configured to store thermal energy or heat. FIG. 2*b* shows an example of an embodiment of a storage unit 201. The storage unit 201 comprises an energy storage 210, in particular a thermal storage or thermal buffer, that in the depicted example comprises a plurality of plates 222, for example metal plates, that are spaced apart from one another via spacers 223. A tempering channel 224 is thus created between two adjacent plates 222, through which tempering channel 224 the drying medium 207 may be directed in order to produce a pre-tempering of the drying medium 207.

In an exemplary embodiment, the energy storage 210 is warmed by one or more heaters 211. In the example depicted in FIG. 2*b*, the plates 222 comprise bores 221 into which rod-shaped heating cartridges 211 may be inserted in order to warm the plates 222.

In an exemplary embodiment, the drying device 150 depicted in FIG. 2*a* comprises a discharge line 202 via which air or drying medium 207 may directed, by means of a blower 205 via a valve 209, in general via a guide element, from the housing 203 of the drying device 150 through the storage unit 201 or past the storage unit 201. The drying medium 207 may then be directed via a supply line 208 to the blowers 165 of the one or more dryers 160. Furthermore, the drying medium 207 may warmed by the one or more heating elements 162 of the individual dryers 160 to the target nominal temperature value 333 so that tempered drying medium 164 is blown onto the recording medium 120.

In an exemplary embodiment, the drying device 150 depicted in FIG. 2*a* also comprises a blower 206 that is configured to blow at least a portion of the air away from the housing 203 of the drying device 160 as exhaust. Furthermore, the drying device 150 may comprise at least one cooling roller 204 that is configured to cool the recording medium 120 with the dried print image at the output of the drying device 150.

In an exemplary embodiment, the controller 101 of the drying device 150 is configured to induce the valve 209 to direct the drying medium 207 across the storage unit 201 at the beginning of a printing phase, in particular as of the third point in time 303, in order to increase the temperature of the drying medium 207. As a result of this, at the individual dryers 160 a pre-tempered drying medium 207 is provided that may be heated to the target nominal temperature value by the one or more heating elements 162 with a reduced energy cost. A printing phase may thus be begun without velocity ramping, even with a limited electrical load 321.

Furthermore, in an exemplary embodiment, the controller 101 is configured to induce the valve 209 to direct the drying medium 207 past the storage unit 201 during the running printing operation in order to enable the storage unit 201 to store thermal energy for the beginning of a subsequent printing phase. In particular, the controller 101 may be configured to determine a time period in which the required electrical load 321 of the printing device 100 and/or of the one or more dryers 150 is below an available maximum load. In this time period, the storage unit 201 may be warmed in order to store thermal energy for the beginning of a subsequent printing phase.

FIG. 3*b* shows the time curve of the temperature 312 of the housing of a dryer 160 and the time curve of the temperature 313 of the drying medium 164 given use of the storage unit 201. Furthermore, FIG. 3*b* shows the time curve of the electrical load 321 given limitation of the electrical load 321 to a maximum possible load value 320.

In an exemplary embodiment, in preparation for the beginning of a printing phase, the drying medium 164 is initially set to the first nominal temperature value 331. A relatively slow rise of the temperatures 312, 313 takes place due to the limitation of the available electrical load 321.

At the point in time 304, after the electrical load 321 has fallen significantly below the maximum possible load value 320, in a charging phase the storage unit 201 may be operated in order to store thermal energy. In the charging phase of the storage unit 201, the heating power for storage unit 201 is to be taken into consideration as the electrical load 321 shown only includes the power consumption of the heating elements 162 of the drying device 150.

FIG. 3*b* shows the time curve of the temperature 314 of the energy storage 210. At the point in time 305, the temperature 314 of the energy storage 210 has reached a nominal value 334 of 270° C., for example, and the heating of the storage unit 201 may be ended.

At the point in time 302, the temperature 313 of the drying medium 164 may be increased to the second nominal temperature 332. Due to the limited electrical load 321, the temperature rise proceeds relatively slowly.

At the point in time 303, i.e. at the beginning of the printing phase, a sudden rise in the temperature 313 of the tempered drying medium 164 may then be produced with the beginning of the movement of the recording medium 120. For this purpose, the drying medium 207 may be directed across the storage unit 201 in order to preheat the drying medium 207 that is provided to a dryer 160, so that the dryer 160 may heat the drying medium 207 to a target nominal temperature value 333 with reduced electrical load 321.

As arises from FIG. 3*b*, the temperature 334 of the storage unit 201 decreases as of the point in time 303 since thermal energy transfers from the energy storage 210 to the drying medium 207. Furthermore, from FIG. 3*b* it is clear that the temperature 313 of the tempered drying medium 164 may be heated nearly instantly to the target nominal temperature value 333 due to the pre-tempering in the storage unit 201, so that no velocity ramping is required at the start of printing.

The drying device 150 according to one or more embodiment may include a buffer storage 210 to buffer the additional energy required at the beginning of a printing phase. The charging of the buffer storage 210 preferably takes place in a phase in which the power consumption of the drying device 150 and/or of the printing device 100 is relatively low. As depicted in FIG. 2*a*, the storage unit 201 may be installed with the buffer storage 210 after the air circulation blower 205 and before the one or more dryers 160 in the air circulation loop of the drying device 150.

In a standby phase, the buffer storage 210 may be charged via an electrical heater 211 before the start of printing. In this time period, the buffer storage 210 may be decoupled from the air circulation loop by a flap or by a valve 209 so that the drying medium 207 flows past the storage unit 201.

At the start of printing, if applicable the heat output at the heater 211 of the storage unit 201 may be switched off and the circulating air, meaning the drying medium 207, having a temperature of, for example, approximately 125° C. may be directed through the buffer storage 210 via repositioning of the flap or valve 209. The circulating air warms up, and the heating elements 162 in the one or more dryers 160 are assisted. This assistance may take place until the heating elements 162 and the walls of the dryers 160 are at the target nominal temperature value 333 of the tempered drying medium 164, and/or until the temperature of the circulating air at the air circulation blower 205 has risen to a defined target value so that less energy is to be supplied to the circulating air. The heating elements 162 in the one or more dryers 160 may provide the energy input subsequently required, even given a load limitation to the maximum possible load value 320. In the next printing pause, the buffer storage 210 may be recharged for the next printing start.

As arises from FIGS. 3*a* and 3*b*, a relatively high heating speed of the drying device 150 at a start of printing may be achieved via the use of a buffer storage 210, even given a limitation of the connected electrical load. Printing with a velocity ramping may thus be omitted. If applicable, the required heat output of the heating elements 162 of the one or more dryers 160 of the drying device 150 may also be reduced.

As depicted in FIG. 2*b*, the buffer storage 210 may comprise metal plates 222 that are installed with spacers 223 in a block. The plates 222 may be electrically heated via heating cartridges. The circulating air of the dryer 207 may flow through the heating channel 224 between the plates 222 and thereby absorb thermal energy from the plates 222. As an alternative or in addition to an electrical resistance, the heating of the plates 222 may take place inductively and/or via radiant heat.

Alternatively or additionally, the storage unit 201 may be configured to store the thermal energy in a storage fluid, for example in a thermal oil, wherein the storage fluid is heated via a heater 211. The transfer of the energy to the circulating air or to the drying medium 207 may take place via a heat exchanger. The storage fluid may thereby be circulated by means of a pump. The pump may take on the function of the flap or the valve 209, since the circulating air or the drying medium 207 may be separated from the thermal storage 210 by deactivating the pump for circulating the storage fluid. The installation of a flap or of a valve 209 may thus be foregone.

If applicable, separating the buffer storage 210 from the circulating air flow after a fixed amount of time after the start of printing may be foregone. In this instance, the storage 210 would slowly assume the temperature of the circulating air during the printing phase, and the energy thereby emitted might be supplied to the printing process. The energy efficiency of the drying device 150 may thus be increased. Alternatively or additionally, the heater 211 of the storage unit 201 may take over a portion of the heat output of the one or more dryers 160 if the storage 210 remains connected with the circulating air flow and the heater 211 of the storage unit 201 is activated. The requirements for the heat output of the heating elements 162 of the dryers 160 may thus be reduced.

A drying device 150 is thus described for drying a recording medium 120 printed to in a printing device. In particular, the drying device 150 may be designed to fix a print image on a recording medium 120 via drying.

The drying device 150 comprises at least one dryer 160 that is configured to warm a gaseous drying medium 207, 164 (e.g. air) using at least one heating element 162, and to blow the heated gaseous drying medium onto the surface of the recording medium 120 that is to be dried or fixed. For this purpose, the dryer 160 may have a blower 165 that blows the drying medium 207, 164 past the one or more heating elements 162 onto the surface of the recording medium 120.

Furthermore, the drying device 150 comprises a storage unit 201 to store energy, in particular to store thermal energy.

The drying device 150 also comprises a controller 101 that is configured to induce energy to be stored in the storage unit 201 in a charging phase. The charging phase may thereby advantageously be situated such that, during the charging phase, the electrical load that is required by the printing device 100 and/or by the one or more dryers 160 is relatively low, in particular at least 20% or 30% below the maximum allowable load 320 for the printing device 100 and/or for the drying device 150. For example, the charging phase may be placed in a printing pause of the printing device 100.

The controller 101 is also configured to induce the drying medium 207, 164 to be warmed with energy from the storage unit 201 and via operation of the heating element 162 of the dryer 160 at the beginning of a printing phase of the printing device 100. In other words, the controller 101 may be configured to use the energy stored in the storage unit 201, in addition to the heating element 162 of the drying medium 160, to warm the drying medium 206, 164 to the required target nominal temperature value 333.

In the following, a drying device 150 is described that comprises a storage unit 201 in which energy may be stored during a charging phase, which energy may be used at the beginning of a subsequent printing phase to warm the drying medium 207, 164 to dry a recording medium 120 that has been printed to. The maximum required connected electrical load 320 of the drying device 150 may thus be efficiently reduced. Furthermore, a relatively rapid warming of the drying medium 207, 164 may be produced via the temporary provisioning of energy from the storage unit 201, which enables the printing phase of the printing device to begin directly at the operating velocity, and thus without a velocity ramping.

The controller 101 may be configured to condition the dryer 160, in preparation for the beginning of a printing phase, such that the drying medium 207, 164 that is blown onto the surface of the recording medium 120 has a momentary nominal temperature value 331, 332. The pre-conditioning of the dryer 160 may thereby, if applicable, take place without using the storage unit 201 in order to have the effect that the storage unit 201 continues to store sufficient energy for the effective beginning of the printing phase.

In an exemplary embodiment, the momentary nominal temperature value 331, 332 may be 10% to 30% below the target nominal temperature value 333 for the subsequent printing phase. In particular, the momentary nominal temperature value 331, 332 may be optimally close to the target nominal temperature value 333, but sufficiently low in order to also produce no negative effect on the recording medium 120 over a relatively long conditioning time period, for instance of 10 minutes or more.

In an exemplary embodiment, the controller 101 is also configured to have the effect, at the beginning of the printing phase, that the drying medium 207, 164 that is blown onto the surface of the recording medium 120 is increased from the momentary nominal temperature value 331, 332 to the target nominal temperature value 333 using the energy from the storage unit 201. The storage unit 201 may thereby in particular be designed such that the temperature 313 of the drying medium 207, 164 that is blown onto the surface of the recording medium 120 is increased from the momentary nominal temperature value 331, 332 to the target nominal temperature value 333 in 20 seconds or less.

Via the pre-conditioning of the dryer 160, the required storage capacity of the storage unit 201 that is required in order to produce a quasi-instantaneous warming of the drying medium 207, 164 to the target nominal temperature value 333 may be reduced. Furthermore, the duration of the warming of the drying medium 207, 164 to the target nominal temperature value 333 may be reduced.

In an exemplary embodiment, the drying device 150 may comprise a guide element 209, in particular a valve and/or a flap, that is designed to selectively direct the drying medium 207, 164 across the storage unit 201 or past the storage unit 201. The controller 101 may be configured to control the guide element 209 such that the drying medium 207, 164 is directed past the storage unit 201 during a charging phase in order to store energy in the storage unit 201. On the other hand, the controller 101 may be configured to control the guide element 209 such that the drying medium 207, 164 is directed through the storage unit 201, in particular at the beginning of a printing phase, in order to warm the drying medium 207, 164 with energy from the storage unit 201. Energy, in particular thermal energy, may thus be efficiently and reliably provided for the beginning of a printing phase.

As has already been presented above, the storage unit 201 may be configured to store thermal energy. The controller 101 may be configured to induce the drying medium 207, 164 to be directed through the storage unit 201 at the beginning of the printing phase in order to pre-warm the drying medium 207, 164 before reaching the dryer 160. The electrical load 321 that is required for the operation of the heating element 162 of the dryer 160 may thereby be reliably and efficiently reduced without thereby extending the time period for the warming of the drying medium 207, 164.

For example, the storage unit 201 may comprise one or more heating plates 222, in particular metallic heating plates 222, that are designed to store thermal energy via warming. Furthermore, the storage unit 201 may comprise one or more heaters 211 that are configured to warm the one or more heating plates. The storage unit 201 may also be designed such that the drying medium 207, 164 may be directed past the one or more warmed heating plates 222 in order to pre-warm the drying medium 207, 164. For example, channels 224 may be provided between the heating plates 222, through which channels 224 the drying medium 207, 164 is directed in order to warm said drying medium 207, 164. Thermal energy may thus be particularly efficiently stored for the beginning of a printing phase.

Alternatively or additionally, the storage unit 201 may comprise a heat exchanger having a storage fluid, for example having an oil. The storage unit 201 may be designed to warm the storage fluid. Furthermore, the heat exchanger may be designed to transfer thermal energy from the storage fluid to the drying medium 207, 164 in order to pre-warm the drying medium 207, 164.

In an exemplary embodiment, the storage unit 201 may comprise a pump that is configured to circulate the storage fluid. The controller 101 may be configured to operate the pump in order to have the effect that the drying medium 207, 164 is warmed by the storage unit 201. Furthermore, the controller 101 may be configured to stop the pump in order to have the effect that the drying medium 207, 164 is not warmed by the storage unit 201 and/or that the storage fluid may be warmed in order to store thermal energy for the beginning of a printing phase. Given the use of a pump to circulate the storage fluid, the use of an additional guide element 209 may be foregone.

In an exemplary embodiment, the drying device 150 may comprise a housing 203 that encloses the dryer 160 and through which the recording medium 120 that has been printed to is directed. Furthermore, the drying device 150 may comprise a blower 205 and one or more conduits 202, 208 that are configured to direct the drying medium 207, 164 from the housing 203 of the drying device 150 to the storage unit 201, and further to the blower 165 of the drying medium 160. A tempered drying medium 207, 164 for drying a recording medium 120 that has been printed to may thus be provided in an energy-efficient manner.

Furthermore, in this document a printing device 100 is described, in particular an inkjet printing device 100, that comprises the drying device 150 described in this document.

FIG. 4 shows a flowchart of a method 400 for drying, according to an exemplary embodiment, by means of a drying device 150, a recording medium 120 that has been printed to in a printing device 100. In an exemplary embodiment, the method 400 includes the storage 401 of energy in the storage unit 201 of the drying device 150 during a charging phase. Furthermore, the method 400 includes, at the beginning of a printing phase of the printing device 100, the warming 402 of the drying medium 207, 164 via operation of the heating elements 162 of the one or more dryers 160 of the drying device 150 and with energy from the storage unit 201.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21, 22 nozzle (print image)
31, 32 column (of the print image)
100 printing device
101 controller
102 print bar
103 print head
120 recording medium
140 print group
150 fixing or drying device
160 dryer
161 controller
162 heating element
163 nozzle
164 tempered drying medium
165 blower
166 temperature sensor
201 storage unit
202 discharge line

203 housing (drying device)
204 cooling roller
205 blower (circulating air)
206 blower (exhaust air)
207 pre-warmed drying medium
208 supply line
210 energy storage
211 heater (storage unit)
221 bore (heating element)
222 storage plate
223 spacer
224 heating channel
301 point in time (begin preheating first stage)
302 point in time (begin preheating second stage)
303 point in time (begin transport of the recording medium)
304 point in time (begin charging of the storage unit)
305 point in time (end charging of the storage unit)
311 nominal temperature of the tempered drying medium
312 real temperature of the dryer
313 real temperature of the tempered drying medium
314 real temperature of the energy storage
320 maximum available connected load
321 input electrical load of the drying device
331 first nominal temperature value
332 second nominal temperature value
333 target nominal temperature value
334 nominal value of the temperature of the storage unit
400 method for drying a recording medium
401-402 method steps

The invention claimed is:

1. A drying device for drying a recording medium having been printed to in a printing device, the drying device comprising:

a dryer configured to warm a gaseous drying medium using at least one heating element and to blow the gaseous drying medium onto a surface of the recording medium;

a storage unit configured to store energy; and a controller that is configured to:

in a charge phase, induce energy to be stored in the storage unit; and at a beginning of a printing phase of the printing device, induce the gaseous drying medium to be warmed with energy from the storage unit and via operation of the heating element of the dryer.

2. The drying device according to claim 1, wherein:

the storage unit is configured to store thermal energy; and the controller is configured to induce the gaseous drying medium, at the beginning of the printing phase, to be directed through the storage unit to pre-warm the gaseous drying medium before reaching the dryer.

3. The drying device according to claim 2, wherein:

the storage unit comprises one or more heating plates that are configured to store thermal energy via warming;

the storage unit comprises one or more heaters that are configured to warm the one or more heating plates; and the storage unit is configured such that the gaseous drying medium is directable past the one or more warmed heating plates to pre-warm the gaseous drying medium.

4. The drying device according to claim 2, wherein:

the storage unit comprises a heat exchanger having a storage fluid;

the storage unit is configured to warm the storage fluid; and the heat exchanger is configured to transfer thermal energy from the storage fluid to the gaseous drying medium to pre-warm the gaseous drying medium.

5. The drying device according to claim 4, wherein:

the storage unit comprises a pump configured to circulate the storage fluid; and the controller is configured to:

operate the pump such that the gaseous drying medium is warmed by the storage unit; and stop the pump such that the gaseous drying medium is not warmed by the storage unit, and/or that the storage fluid is warmed to store thermal energy usable at the beginning of a printing phase.

6. The drying device according to claim 1, wherein the drying device further comprises:

a housing configured to enclose the dryer and through which the recording medium having been printed to is directed; and a blower and one or more conduits that are configured to guide the gaseous drying medium from the housing of the drying device to the storage unit and further to a blower of the dryer.

7. The drying device according to claim 1, wherein:

the drying device comprises a guide configured to direct the gaseous drying medium selectively across the storage unit and past the storage unit (201);

the controller is configured to control the guide to selectively:

direct the gaseous drying medium past the storage unit during the charging phase to store energy in the storage unit (201); and direct the gaseous drying medium through the storage unit at the beginning of the printing phase to warm the gaseous drying medium with stored energy from the storage unit.

8. The drying device according to claim 7, wherein the guide is a valve or a flap.

9. The drying device according to claim 1, wherein the controller is configured to:

condition the dryer, in preparation for the beginning of the printing phase, such that the gaseous drying medium blown onto the surface of the recording medium has a momentary nominal temperature value that is 10% to 30% below a target nominal temperature value; and at the beginning of the printing phase, increase the gaseous drying medium blown onto the surface of the recording medium from the momentary nominal temperature value to the target nominal temperature value using the stored energy from the storage unit.

10. The drying device according to claim 9, wherein the storage unit is configured such that the temperature of the gaseous drying medium blown on the surface of the recording medium is increased from the momentary nominal temperature value to the target nominal temperature value in 20 seconds or less.

11. A method for drying a recording medium using a drying device, the recording medium being printed to in a printing device, the drying device including at least one dryer configured to warm a gaseous drying medium using at least one heating element and to blow the gaseous drying medium onto a surface of the recording medium, the drying device including at least one storage unit configured to store energy, the method comprising:

storing energy in the storage unit during a charging phase; and at a beginning of a printing phase of the printing device, warming the drying medium via operation of the heating element of the dryer and with stored energy from the storage unit.

12. The method according to claim 11, wherein the charging phase precedes the beginning of the printing phase.

13. The method according to claim 11, wherein the energy stored in the storage unit is thermal energy.

14. A non-transitory computer-readable storage medium with an executable program stored thereon, wherein, when executed, the program instructs a processor to perform the method of claim 11.

* * * * *